US010883433B2

(12) United States Patent
Glugla et al.

(10) Patent No.: US 10,883,433 B2
(45) Date of Patent: Jan. 5, 2021

(54) SYSTEMS AND METHODS FOR OXYGEN SENSOR LIGHT-OFF

(71) Applicant: Ford Global Technologies, LLC, Dearborn, MI (US)

(72) Inventors: Christopher Paul Glugla, Macomb, MI (US); Kenneth Ellison, Belleville, MI (US); Hao Zhang, Ann Arbor, MI (US); John Roth, Grosse Ile, MI (US); Gopichandra Surnilla, West Bloomfield, MI (US); John Virga, Farmington Hills, MI (US); Richard E. Soltis, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 30 days.

(21) Appl. No.: 16/223,948

(22) Filed: Dec. 18, 2018

(65) Prior Publication Data

US 2020/0191083 A1 Jun. 18, 2020

(51) Int. Cl.

| | |
|---|---|
| ***F02D 41/14*** | (2006.01) |
| ***F02D 41/24*** | (2006.01) |
| ***F02D 41/00*** | (2006.01) |

(52) U.S. Cl.

CPC ..... *F02D 41/1454* (2013.01); *F02D 41/0055* (2013.01); *F02D 41/1475* (2013.01); *F02D 41/1495* (2013.01); *F02D 41/2454* (2013.01); *F02D 41/2474* (2013.01); *F01N 2550/22* (2013.01); *F01N 2560/20* (2013.01); *F01N 2900/0416* (2013.01); *F01N 2900/0602* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,404,720 | A | 4/1995 | Laing | |
| 5,852,228 | A | 12/1998 | Yamashita et al. | |
| 5,966,931 | A | 10/1999 | Yoshizaki et al. | |
| 6,009,866 | A * | 1/2000 | Sagisaka | F02D 41/1455 123/681 |
| 6,094,975 | A * | 8/2000 | Hasegawa | G01N 27/4067 123/688 |
| 6,384,386 | B2 * | 5/2002 | Hashimoto | G01N 27/122 123/697 |

(Continued)

FOREIGN PATENT DOCUMENTS

| | | | |
|---|---|---|---|
| DE | 10229026 | A1 | 1/2004 |
| JP | 2009281867 | A | 12/2009 |

OTHER PUBLICATIONS

Surnilla, G. et al., "Systems and Methods for Reducing a Light-Off Time of an Oxygen Sensor," U.S. Appl. No. 15/811,085, filed Nov. 13, 2017, 45 pages.

*Primary Examiner* — Binh Q Tran
(74) *Attorney, Agent, or Firm* — Geoffrey Brumbaugh; McCoy Russell LLP

(57) ABSTRACT

Methods and systems are provided for a battery supplying power to an exhaust oxygen sensor heater. In one example, a method may include estimating a power delivered to the heater during heating of the sensor and in response to a power delivered from a battery being lower than a threshold, adjusting a battery charging strategy prior to an immediately subsequent engine start.

19 Claims, 6 Drawing Sheets

(56) References Cited

U.S. PATENT DOCUMENTS

| | | | | |
|---|---|---|---|---|
| 6,892,541 | B2 * | 5/2005 | Suzuki | B60K 6/48 60/706 |
| 7,467,628 | B2 | 12/2008 | Adams et al. | |
| 10,066,567 | B2 * | 9/2018 | Kato | F02D 41/1495 |
| 2017/0241360 | A1 * | 8/2017 | Ohsaki | G07C 5/00 |

* cited by examiner

SYSTEMS AND METHODS FOR OXYGEN SENSOR LIGHT-OFF

FIELD

The present description relates generally to methods and systems for a battery used for exhaust gas oxygen sensor heating in a vehicle system.

BACKGROUND/SUMMARY

Intake and/or exhaust gas sensors may provide indications of various gas constituents in an engine system. For example, an oxygen sensor positioned in an engine exhaust system may be used to determine the air-fuel ratio (AFR) of exhaust gas, while an oxygen sensor positioned in an engine intake system may be used to determine a concentration of recirculated exhaust gas in intake charge air. Both parameters, among others that may be measured via an oxygen sensor, may be used to adjust various aspects of engine operation. For example, an engine may be controlled in a closed-loop manner to achieve a desired exhaust gas AFR based on the AFR indicated by an oxygen sensor. Such closed-loop AFR control may maximize operating efficiency of an emission control device to reduce vehicle emissions, for example. For some oxygen sensors, their output may significantly vary as a function of their temperature. Prior to the oxygen sensor reaching its light-off temperature, the AFR may be controlled in an open-loop manner, which is less accurate than the closed-loop control. Accordingly, oxygen sensors may be heated by a heating element to bring the sensor temperature within a desired range, such as above a light-off temperature, to provide accurate oxygen sensing for closed-loop AFR control. For heating the oxygen sensor, power may be supplied from an on-board battery. The on-board battery may also be used for operating a starter motor for engine cranking during an engine start.

Various approaches are provided for expediting heating of an oxygen sensor. In one example, approach, as shown in DE 10229026, Eberlein et al. shows, during heating of an oxygen sensor via a heater, monitoring a drop in voltage across the heater, and using a field effect transistor (FET) to compensate for the voltage drop. For oxygen sensor heating, a switching arrangement including a FET current limiting device and a micro controller is used to allow rapid response and avert uncontrolled current by incrementing an electromotive force effectively applied up to full battery voltage over an interval.

However, the inventors herein have recognized potential issues with such systems. As one example, due to changes in battery performance, power supplied by the battery may not be sufficient to increase the temperature of the oxygen sensor to above the light-off temperature within a desirable time. During cold-start, a delay in oxygen sensor heating may result in prolonged AFR control in an open-loop manner, thereby increasing cold-start emissions. A battery with lower state of charge (SOC) or a degraded battery may have a higher impact on oxygen sensor heating and consequently on emissions during a cold-start.

The inventors herein have recognized that the issues described above may be addressed by a method comprising: in response to a power delivered from a battery, as estimated based on a drop in voltage during heating of an exhaust gas oxygen sensor, adjusting a battery charging strategy. In this way, battery performance may be improved by adjusting a battery charging strategy based on a power delivered during an oxygen sensor heating, during subsequent engine starts, so that oxygen sensor heating may be expedited.

In one example, during a cold start condition, an exhaust oxygen sensor may be heated via a dedicated heater powered by the on-board vehicle battery. During the heating of the oxygen sensor, a drop in battery voltage may be monitored and a power delivered to the oxygen sensor heater for heating the sensor may be estimated. The estimated power may be compared to a first threshold power and a second threshold power. If it is determined that the estimated power is lower than the first threshold, it may be inferred that the battery is degraded and the operator may be notified. If the estimated power is lower than the second threshold (but higher than the first threshold), battery charging strategy prior to an immediately subsequent engine start may be adjusted such that the battery state of charge may be increased to a higher extend prior to engaging the battery for powering the oxygen sensor heater. Also, after completion of oxygen sensor heating, based on the time taken for the battery voltage to recover from the voltage drop, power delivered to the oxygen sensor heater during an immediately subsequent engine start may be adjusted. An alternator may be engaged to provide power to the heater and compensate for lower battery power supply.

In this way, by monitoring power delivered for heating an oxygen sensor during a cold start, battery performance may be monitored. By adjusting the power delivered to the heater during subsequent engine starts based on the voltage drop during oxygen sensor heating, oxygen sensor heating may be improved. The technical effect of adjusting battery recharging strategy based on the power delivered for oxygen sensor heating is that during subsequent engine cold-starts, a desired amount of battery power may be available to the sensor heater for expedited oxygen sensor heating. By expediting oxygen sensor heating during cold starts, AFR control in a closed-loop manner may be initiated earlier, thereby improving emissions quality.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
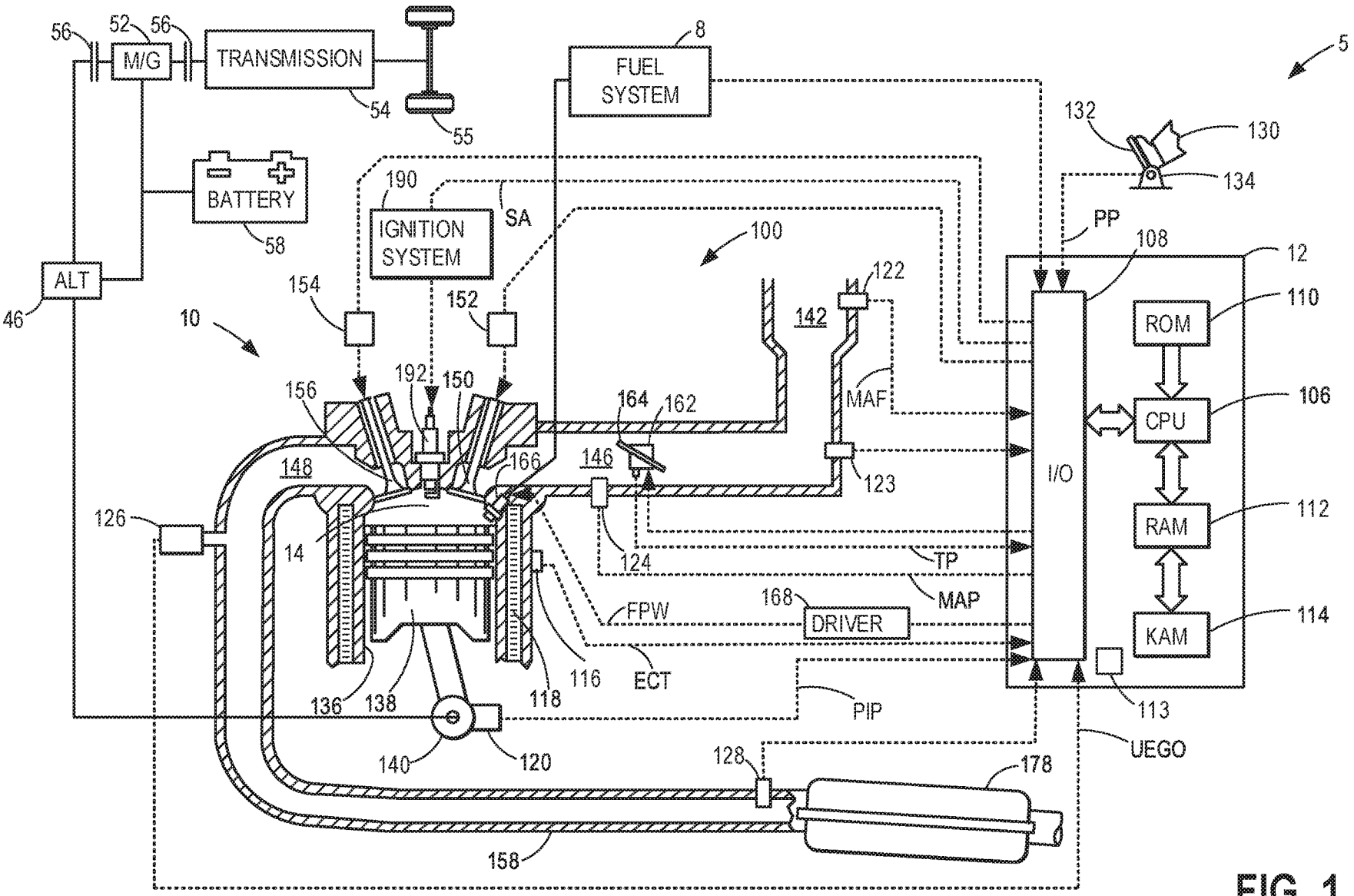
FIG. 1 shows a schematic depiction of an engine system of a vehicle.
Figure 2:
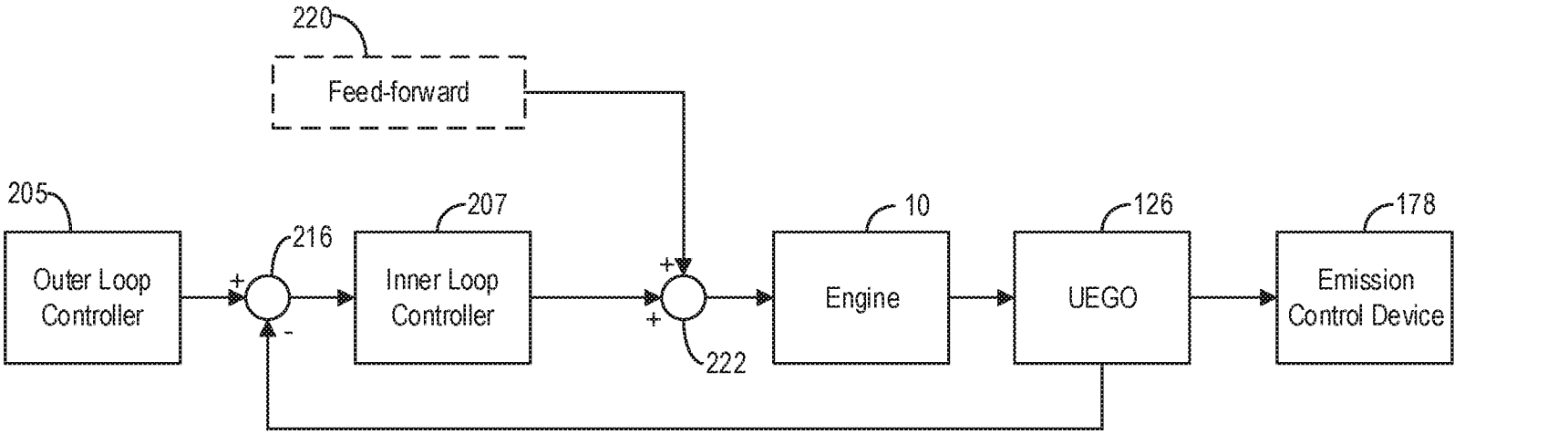
FIG. 2 shows a block diagram illustrating an example control architecture for generating a fuel command using feedback from an oxygen sensor.

The following description relates to systems and methods for monitoring performance of an on-board battery used for heating an oxygen sensor during an engine cold start. As shown in FIG. 1, an engine system may include an exhaust gas oxygen sensor upstream of an emission control device. The upstream exhaust gas oxygen sensor may be a UEGO sensor, such as the example UEGO sensor diagrammed in FIG. 3, configured to measure an amount of oxygen in the exhaust gas. Engine operation may be controlled based on feedback from the UEGO sensor, as shown in FIG. 2, in order to achieve a desired AFR. During an engine cold start, such as when the engine has cooled to ambient temperature, the UEGO sensor is below its light-off temperature and cannot be used for AFR feedback because the oxygen sensor's output current is not proportionate to a concentration of oxygen sensed by the oxygen sensor. An engine controller may be configured to perform an example routine, such as according to the method described in FIG. 5, for monitoring performance of the on-board battery, diagnosing degradation of the battery, and adjusting battery output during oxygen sensor heating at subsequent cold-start conditions. An example monitoring of the battery is shown in FIG. 6.

FIG. 1 depicts an example of a cylinder 14 of an internal combustion engine 10, which may be included in an engine system 100 in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of the vehicle via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown in FIG. 1, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via an intake passage 142 and an intake manifold 146. Intake manifold 146 can communicate with other cylinders of engine 10 in addition to cylinder 14. In some examples, intake passage 142 may include one or more boosting devices, such as a turbocharger or a supercharger, coupled therein when the engine system is a boosted engine system. A throttle 162 including a throttle plate 164 may be provided in the intake passage for varying the flow rate and/or pressure of intake air provided to the engine cylinders. An exhaust manifold 148 can receive exhaust gases from cylinder 14 as well as other cylinders of engine 10.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

An exhaust gas sensor 126 is shown coupled to exhaust manifold 148 upstream of an emission control device 178, coupled within an exhaust passage 158. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor configured to provide an output, such as a voltage signal, that is proportional to an amount of oxygen present in the exhaust gas. An example UEGO sensor configuration will be further described with respect to FIG. 3. Emission control device 178 may be a three-way catalyst, a NOx trap, various other emission control devices, or combinations thereof. In the example of FIG. 1, emission control device 178 is a three-way catalyst configured to reduce NOx and oxidize CO and unburnt hydrocarbons.

The output current of UEGO sensor 126 may be used to adjust engine operation. For example, the amount of fuel delivered to cylinder 14 may be varied using a feed-forward (e.g., based on desired engine torque, engine airflow, etc.) and/or feedback (e.g., using oxygen sensor output) approach. Turning briefly to FIG. 2, a block diagram of a control architecture 200 that may be implemented by an engine controller, such as controller 12 shown in FIG. 1, for generating a fuel command is illustrated. Components described in FIG. 2 that have the same identification labels as components shown in FIG. 1 are the same devices and operate as previously described. For example, control architecture 200 includes engine 10 and UEGO sensor 126 upstream of emission control device 178.

Control architecture 200 regulates the engine AFR to a set point near stoichiometry (e.g., a commanded AFR) in a closed-loop manner. Inner loop controller 207, comprising a proportional-integral-derivative (PID) controller, controls the engine AFR by generating an appropriate fuel command (e.g., fuel pulse width). Summing junction 222 optionally combines the fuel command from inner loop controller 207 with commands from a feed-forward controller 220. This combined set of commands is delivered to the fuel injectors of engine 10, such as fuel injector 166 shown in FIG. 1.

UEGO sensor 126 provides a feedback signal to inner loop controller 207. The UEGO feedback signal is proportional to the oxygen concentration in the engine exhaust between engine 10 and emission control device 178. The oxygen concentration may be indicative of an engine air-fuel ratio. For example, the output of UEGO sensor 126 may be used to evaluate an error between a commanded (e.g., desired) AFR and an actual (e.g., measured) AFR. Under nominal UEGO sensor operating conditions (e.g., after UEGO sensor 126 has reached its light-off temperature where sensor output current is proportionate to concentration of oxygen sensed), such an error may be due to fuel injector and/or air metering errors, for example.

An outer loop controller 205 generates a UEGO reference signal provided to inner loop controller 207. The UEGO reference signal corresponds to a UEGO output indicative of the commanded AFR. The UEGO reference signal is combined with the UEGO feedback signal at junction 216. The error or difference signal provided by junction 216 is then used by inner loop controller 207 to adjust the fuel command to drive the actual AFR of engine 10 to the desired AFR. Outer loop controller 205 may be any reasonable controller containing an integral term, such as a proportional-integral (PI) controller.

In this way, controller 12 may accurately control the AFR of engine 10 based on feedback from UEGO sensor 126 and adaptively learn fuel injector and/or air metering errors, which can then be compensated for by adjusting the fuel command (e.g., signal FPW) until the actual AFR reaches the desired AFR. For example, if UEGO sensor 126 measures a rich fuel condition, an amount of fuel delivered will be reduced (e.g., by reducing a pulse-with of signal FPW). Conversely, if UEGO sensor 126 measures a lean fuel condition, the amount of fuel delivered will be increased (e.g., by increasing a pulse-width of signal FPW). However, the closed-loop fuel control of control architecture 200 may not be utilized before UEGO sensor 126 reaches its light-off temperature, as oxygen measurements taken prior to UEGO sensor 126 reaching its light-off temperature may not be accurate. For example, UEGO sensor 126 may not have reached its light-off temperature during an engine cold start, as further described below.

During cold start conditions, the exhaust gas sensor 126 may be heated via a heater coupled to the sensor until the sensor reaches its light-off temperature. Power for heating the exhaust gas sensor 126 (via the dedicated heater) may be provided from the battery 58. A threshold magnitude of power is desired by the heater for expedited heating (such as within 5 seconds) of the exhaust gas sensor 126 such that closed-loop fuel control may be initiated. If the battery is degraded or having a lower state of charge (SOC), a lower power may be delivered to the heater which may adversely affect exhaust gas sensor 126 heating. A voltage drop (across the heater) during heating of the exhaust gas oxygen sensor 126 may be a function of a current flowing through a circuit of the heater and a resistance of the circuit, and the power may be a function of the current flowing through the circuit of the heater and the resistance of the circuit. Degradation of the battery may be indicated in response to the power being lower than a first threshold power. During an immediately subsequent engine start, the battery charging strategy may be adjusted based on the power being lower than a second threshold power, the second threshold power higher than the first threshold power.

In one example, adjusting the battery charging strategy may include, during heating of the UEGO sensor at the immediately subsequent engine start, engaging an alternator to supply power to a heater, the power supplied by the alternator proportional to a difference between the power supplied by the battery and the second threshold power. In another example, adjusting the battery charging strategy may include shedding load on the battery from one or more vehicle components during heating of the oxygen sensor, the one or more vehicle components including cabin heating system. In yet another example, adjusting the battery charging strategy may include charging the battery aggressively to reach a maximum state of charge prior to an immediately subsequent engine start. An engine start may be any time between engaging a starter (or another electric machine) and the engine reaching idle speed. The heating of the oxygen sensor 126 may be continued until an operating temperature is reached where output current of the oxygen sensor is proportional to a concentration of oxygen sensed via the oxygen sensor.

Returning to FIG. 1, controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an ambient temperature from a temperature sensor 123 coupled to intake passage 142; an exhaust gas temperature from a temperature sensor 128 coupled to exhaust passage 158; a profile ignition pickup signal (PIP) from a Hall effect sensor 120 (or other type) coupled to crankshaft 140; throttle position (TP) from the throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature. Further, controller 12 is shown having a current sensor 113, which may be used to detect a current output by a sensor, such as UEGO sensor 126, as further described below. Additional sensors, such as various temperature, pressure, and humidity sensors, may be coupled throughout vehicle 5.

Controller 12 receives signals from the various sensors of FIG. 1 and employs the various actuators of FIG. 1 to adjust engine operation based on the received signals and instructions stored on a memory of the controller. For example, the controller may determine an amount of power supplied by the battery 58 for heating the UEGO sensor 126, and monitor operation of the battery 58, as will be described with respect to FIG. 4. Also, the controller may determine an amount of power (and a corresponding voltage) to supply to a heater of UEGO sensor 126 during subsequent engine starts to quickly raise UEGO sensor 126 to its operating temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 3:
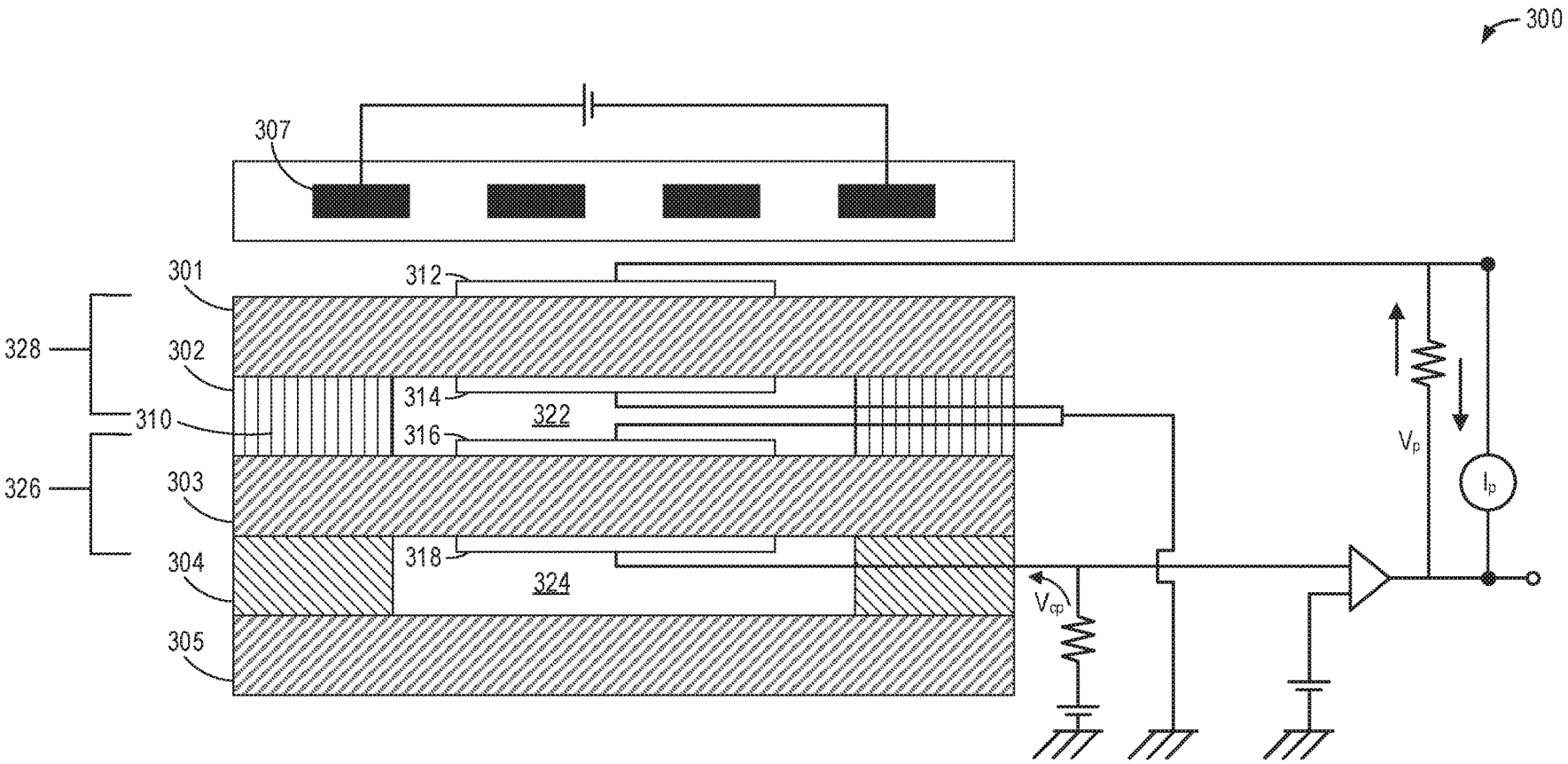
FIG. 3 shows a schematic diagram of an example oxygen sensor.

Next, FIG. 3 shows a schematic view of an example configuration of an oxygen sensor 300 for measuring a concentration of oxygen ($O_2$) in an intake airflow in an intake passage or an exhaust gas stream in an exhaust passage of an engine. Oxygen sensor 300 may operate as UEGO sensor 126 of FIGS. 1 and 2, for example. Oxygen sensor 300 comprises a plurality of layers of one or more ceramic materials arranged in a stacked configuration. In the example of FIG. 3, five ceramic layers are depicted as layers 301, 302, 303, 304, and 305. These layers include one or more layers of a solid electrolyte capable of conducting oxygen ions. Examples of suitable solid electrolytes include, but are not limited to, zirconium oxide-based materials. Further, in some embodiments, a heater 307 may be disposed in thermal communication with the layers to increase the ionic conductivity of the layers. As an example, the temperature of heater 307 may correspond to the temperature of oxygen sensor 300 due to the close physical proximity of heater 307 with the ceramic layers. While the depicted oxygen sensor 300 is formed from five ceramic layers, it will be appreciated that oxygen sensor 300 may include other suitable numbers of ceramic layers.

Layer 302 includes a material or materials creating a diffusion path 310. The diffusion path 310 may be configured to allow one or more components of intake air or exhaust gas, including but not limited to a desired analyte (e.g., $O_2$), to diffuse into a first internal cavity 322 at a more limiting rate than the analyte can be pumped into or out of first internal cavity 322 by a pair of pumping electrodes 312 and 314. In this manner, a stoichiometric level of $O_2$ may be obtained in first internal cavity 322.

Oxygen sensor 300 further includes a second internal cavity 324 within layer 304, which is separated from first internal cavity 322 by layer 303. Second internal cavity 324 is configured to maintain a constant oxygen partial pressure equivalent to a stoichiometric condition. An oxygen level (e.g., concentration) present in second internal cavity 324 is equal to the oxygen level that the intake air or exhaust gas would have if the air-fuel ratio were stoichiometric. The oxygen concentration in second internal cavity 324 is held constant by a pumping voltage $V_{cp}$. For example, second internal cavity 324 may be a reference cell.

A pair of sensing electrodes 316 and 318 is disposed in communication with first internal cavity 322 and second internal cavity 324. Sensing electrodes 316 and 318 detect a concentration gradient that may develop between first internal cavity 322 and second internal cavity 324 due to an oxygen concentration in the intake air or exhaust gas that is higher than or lower than the stoichiometric level. A high oxygen concentration may be caused by a lean mixture, while a low oxygen concentration may be caused by a rich mixture. Together, layer 303 and sensing electrodes 316 and 318 comprise a sensing cell 326.

The pair of pumping electrodes 312 and 314 is disposed in communication with first internal cavity 322 and is configured to electrochemically pump a selected gas constituent (e.g., $O_2$) from first internal cavity 322, through layer 301, and out of oxygen sensor 300. Alternatively, the pair of pumping electrodes 312 and 314 may be configured to electrochemically pump a selected gas through layer 301 and into internal cavity 322. Together, layer 301 and pumping electrodes 312 and 314 comprise a pumping cell 328.

The electrodes 312, 314, 316, and 318 may be made of various suitable materials. In some embodiments, the electrodes 312, 314, 316, and 318 may be at least partially made of a material that catalyzes the dissociation of molecular oxygen. Examples of such materials include, but are not limited to, platinum and silver.

The process of electrochemically pumping the oxygen out of or into the first internal cavity 322 includes applying a pumping voltage $V_p$ across pumping cell 328 (e.g., across the pumping electrode pair 312 and 314). The pumping voltage $V_p$ applied to pumping cell 328 pumps oxygen into or out of the first internal cavity 322 in order to maintain a stoichiometric level of oxygen therein. The resulting pumping current $I_p$ is proportional to the concentration of oxygen in the intake air or exhaust gas when the oxygen sensor is at operating temperature (e.g., above light off temperature), which may be used to adjust engine operation, as described with respect to FIG. 2. A control system (not shown in FIG. 3) generates the pumping current signal $I_p$ as a function of the intensity of the applied pumping voltage $V_p$ required to maintain a stoichiometric level within first internal cavity 322. Thus, a lean mixture will cause oxygen to be pumped out of first internal cavity 322, and a rich mixture will cause oxygen to be pumped into first internal cavity 322.

It should be appreciated that the oxygen sensor described herein is merely an example embodiment of an oxygen sensor, and that other embodiments of oxygen sensors may have additional and/or alternative features and/or designs.

Because the output of an oxygen sensor (e.g., oxygen sensor 300 of FIG. 3) may vary significantly with temperature, accurate control of the oxygen sensor temperature may be desired. For example, the oxygen sensor may provide desired sensing above a lower threshold temperature. The lower threshold temperature may be a light-off temperature of the oxygen sensor, for example (e.g., between 720° C. and 830° C.). Therefore, the oxygen sensor temperature may be raised to the lower threshold temperature under conditions in which the oxygen sensor temperature is below the lower threshold temperature (e.g., at an engine cold start). For example, the oxygen sensor temperature may be raised to the lower threshold temperature during an oxygen sensor heat up period via a heater of the oxygen sensor (e.g., heater 307 of FIG. 3). The heater 307 may be comprised of one or more materials (e.g., platinum), where a resistance (R) of the one or more materials is directly proportional (e.g., linear) to its temperature (7). In order to reach the light-off temperature within a desired duration (such as within 5 seconds of engine start), a threshold amount of battery power may be desired for heater 307 operation.

In this way, the systems discussed above at FIGS. 1-3 may enable a controller storing executable instructions in non-transitory memory that, when executed, cause the controller to: during a cold-start, supply voltage from a battery to a heater coupled to an oxygen sensor, housed in an exhaust passage, configured to measure an amount of oxygen in exhaust gas, to increase a temperature of the oxygen sensor to a light-off temperature, estimate a drop in voltage from a nominal battery voltage, estimate a recovery time for the voltage to increase to the nominal voltage, estimate a power supplied to the heater based on the drop in voltage, the nominal voltage, and the recovery time, and indicate the battery to be degraded in response to the power supplied being lower that a threshold power.

Figure 4:
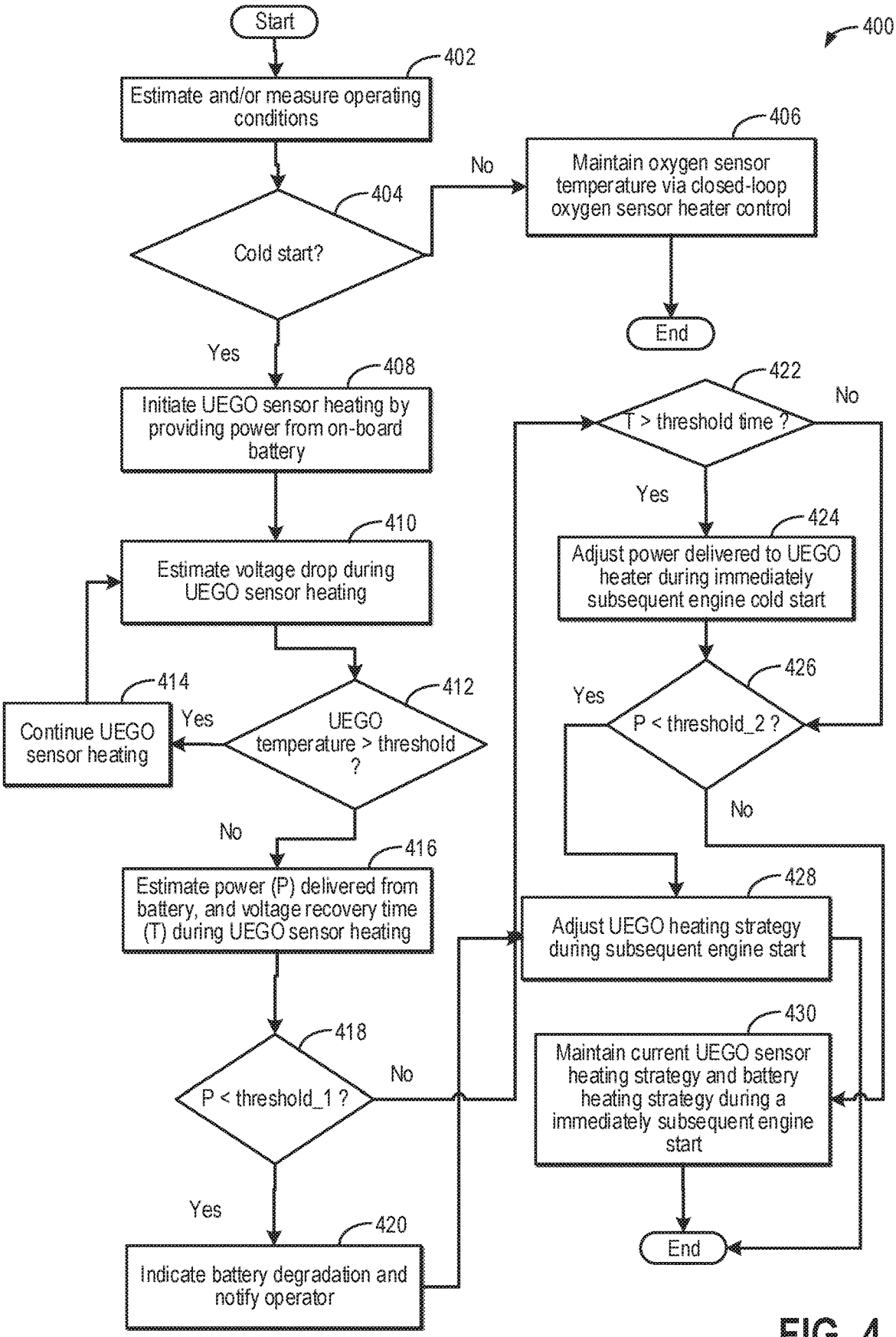
FIG. 4 shows a flowchart for an example method for monitoring battery performance based on oxygen sensor heating.

FIG. 4 shows a flow chart for a high-level example method 400 for monitoring performance of a battery (such as battery 58 in FIG. 1) used for supplying power to a heater of an exhaust gas oxygen sensor (e.g., prior to the oxygen sensor reaching its light-off temperature). For example, the oxygen sensor may be a UEGO sensor included in an engine system, such as UEGO sensor 126 included in engine system 100 of FIG. 1. The oxygen sensor heater (e.g., heater 307 of FIG. 3) may raise a temperature of the oxygen sensor above its light-off temperature and then maintain the temperature of the oxygen sensor at a desired operating temperature. By conducting such diagnostics, degradation of the battery may be identified, charging of the battery may be optimized, and UEGO sensor heating may be improved during subsequent engine starts. Method 400 may be carried out by a controller, such as controller 12 in FIG. 1, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1.

At 402, method 400 includes estimating and/or measuring operating conditions. Operating conditions may include engine speed, engine load, engine temperature (e.g., as measured by an engine coolant temperature sensor, such as temperature sensor 116 of FIG. 1), exhaust gas temperature (e.g., as measured by an exhaust gas temperature sensor, such as temperature sensor 128 of FIG. 1), ambient temperature (e.g., as measured by an ambient temperature sensor, such as temperature sensor 123 of FIG. 1), and oxygen sensor temperature, for example. Engine speed may be determined based on a signal PIP output by a Hall effect sensor (e.g., Hall effect sensor 120 of FIG. 1), for example. Engine load may be determined based on a measurement of MAF from a MAF sensor (e.g., MAF sensor 122 of FIG. 1). As one example, the oxygen sensor temperature may be estimated based on the resistance of the oxygen sensor heater, such as according to a resistance-temperature transfer function (e.g., $R=m\times T+b$). Further, the resistance may be determined based on an amount of voltage and current applied to the oxygen sensor heater, for example. As another example, following a vehicle key-on event and when a threshold duration has elapsed since the previous drive cycle (e.g., since the previous vehicle key-off event) and/or when the measured ambient temperature is substantially equal to the measured exhaust temperature (e.g., within a threshold), the oxygen sensor temperature may be estimated as the measured ambient temperature.

At 404, it is determined if a cold start condition is present. The cold start condition may be confirmed when the engine is started (e.g., cranked from zero speed to a non-zero speed, with fuel and spark provided to initiated combustion) responsive to an engine start request after a prolonged period of engine inactivity (e.g., after greater than a threshold duration of inactivity) and/or while the engine temperature is lower than a threshold temperature (such as below a light-off temperature of an emission control device). As another example, the cold start condition may be confirmed when the engine temperature is substantially equal to the ambient temperature (e.g., within a threshold of the ambient temperature) at engine start. As another example, the cold start condition may be confirmed when the engine has soaked for a duration long enough for the emission control device to cool below the light-off temperature.

If an engine cold start condition is not present, such as when the engine temperature is greater than the threshold temperature or when an engine start is not present, method 400 proceeds to 406 and includes maintaining the oxygen sensor temperature via closed loop oxygen sensor heater control. For example, due to the linear relationship between oxygen sensor heater resistance and oxygen sensor temperature, the oxygen sensor resistance may be used as feedback for maintaining the oxygen sensor temperature. The oxygen sensor heater resistance at a given time after voltage is initially applied to the oxygen sensor may be determined based on a voltage applied to the oxygen sensor heater (V) and a resulting heater current (1), such as according to the equation (Ohm's law): $R=V/I$. For example, the heater current may be detected by a current sensor (e.g., current sensor 113 of FIG. 1). The heater may be maintained at a desired operating temperature corresponding to a desired resistance by adjusting the amount (e.g., duty cycle) of voltage supplied to the heater to drive the heater resistance to the desired resistance. Following 406, method 400 ends.

If an engine cold start condition is present, method 400 proceeds to 408 and heating of the UEGO sensor is initiated by providing power from the battery. The controller may send a command to a switch to close a circuit supplying current to the heater. In one example, a nominal voltage of 12.5 V may be supplied from the battery to the heater. During engine start, battery power may also be used for operating a starter motor to crank the engine. In one example, the UEGO sensor heating may continue after completion of engine cranking.

At 410, a drop in voltage (from the nominal voltage) during the UEGO sensor heating may be estimated. In one example, a voltage drop across the heater may be estimated via a voltmeter housed in the heater circuit. In one example, the voltage drop may be estimated based on an estimated heater current as detected by a current sensor (e.g., current sensor 113 of FIG. 1) and the heater resistance. In one example, the heater resistance may be 2.2 ohms. In another example, a drop in battery voltage may be estimated across the battery. The total drop in battery voltage may be due to cranking, UEGO sensor heating, and other electrical loads. In one example, a drop in battery voltage caused by the UEGO sensor may be estimated from the total battery voltage drop by subtracting a voltage drop due to cranking and other electrical loads. In another example, a drop in battery voltage caused by the UEGO sensor may be estimated after completion of engine cranking and when no other electrical load is applied on the battery.

At 412, the routine includes determining if the UEGO temperature is higher than a threshold temperature. The threshold temperature may correspond to the light-off temperature above which the UEGO sensor may be able to accurately estimate exhaust oxygen level. If it is determined that the UEGO sensor temperature is lower than the threshold, at 414, the UEGO sensor may be continued to be heated by supplying power from the battery.

If it is determined that the UEGO temperature is higher than the threshold, at 416, the controller may estimate a power (P) delivered from the battery for heating the UEGO sensor and a voltage recovery time (T) during UEGO sensor heating. Power delivered may be estimated based on integrating an area in the voltage drop curve and voltage recovery time may be the time required for the voltage to increase from its lowest value (during the voltage drop) to the nominal battery voltage.

Figure 5:
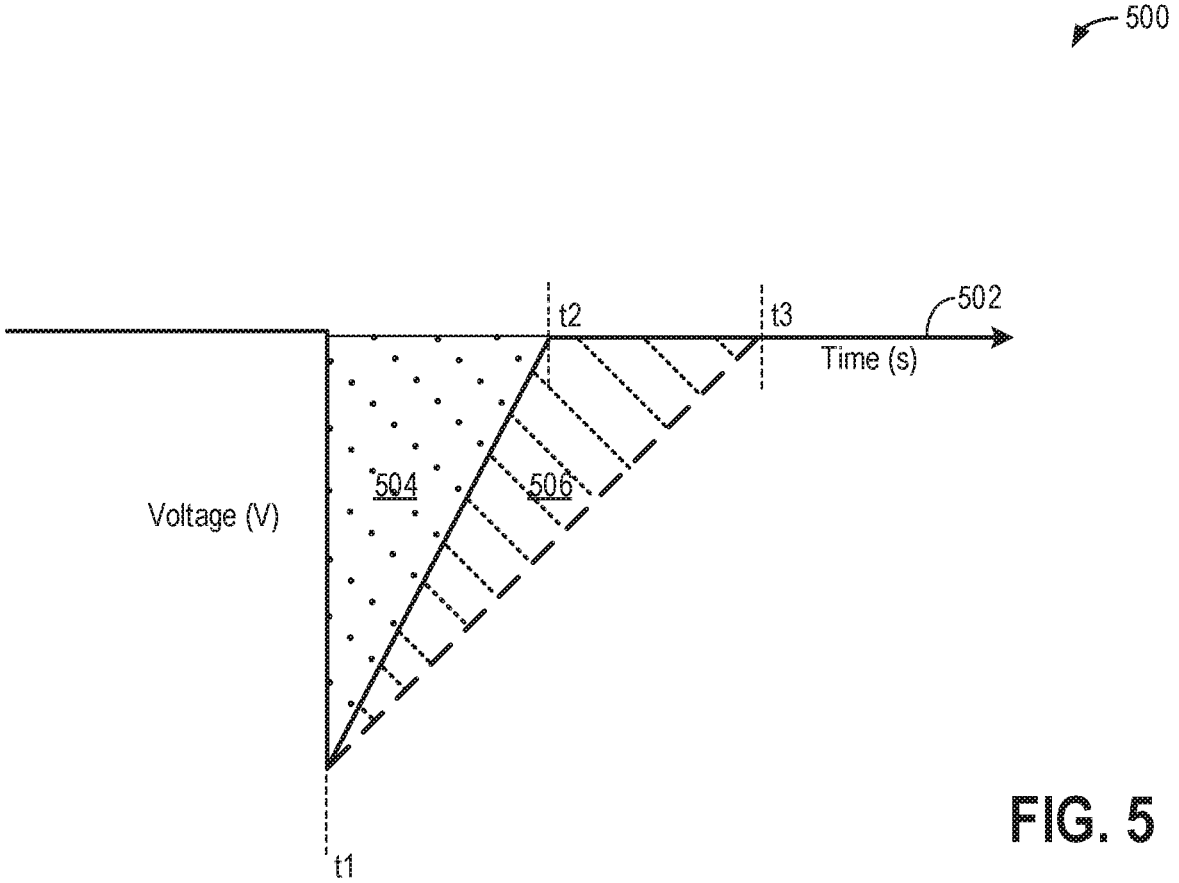
FIG. 5 shows an example plot for a battery voltage drop during heating of the oxygen sensor.
Figure 6:
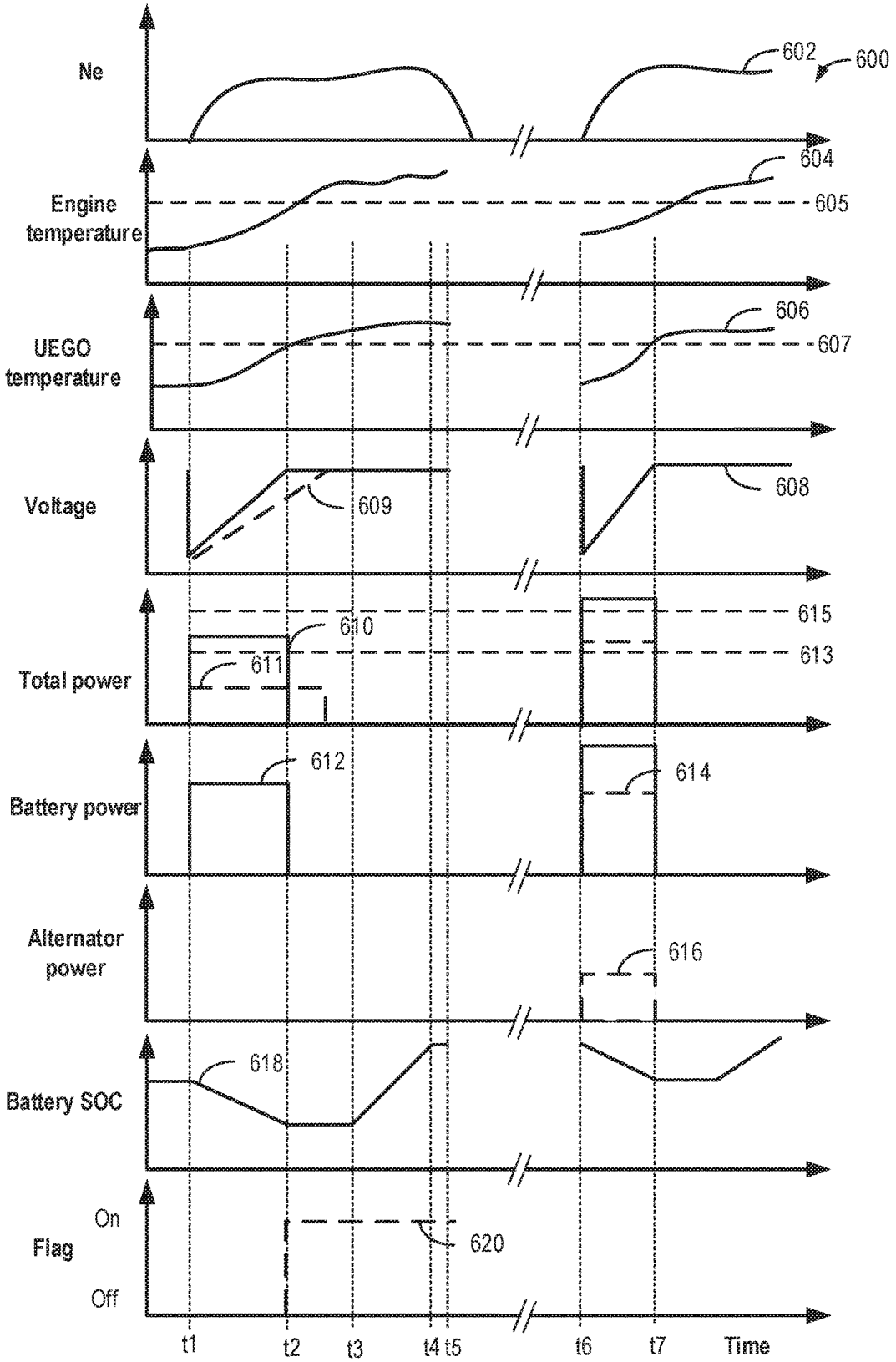
FIG. 6 shows an example of battery performance monitoring

Turning to FIG. 5, an example plot 500 shows a battery voltage drop during UEGO sensor heating. The x-axis denotes time and the y-axis denotes voltage. The UEGO sensor heating is initiated at time t1 and prior to the initiation of UEGO sensor heating, the voltage may be at the nominal battery voltage. In one example, the nominal battery voltage may be 12.5 V. The UEGO sensor may be heated between time t1 and t2 and the recovery time may be the difference between time t2 and t1. The power delivered from the battery for heating the UEGO sensor may be inversely proportional to the area 504 under the curve (dotted area in this plot). The power delivered may be estimated by integrating the voltage drop during UEGO sensor heating. The integrated power lost to voltage drop and recovery time may be subtracted from power delivered over time assuming no drop in voltage to estimate the power delivered.

Power delivered may be estimated using the equation: $P=I^2\times R$, where I is the current delivered to the heater for UEGO sensor heating and R is the heater resistance. Due to degradation or inadequate charging, if the battery performance is not optimal, the UEGO sensor heating may take a longer time and the recovery time may be the difference between time t3 and t1. Also, the area (504 and 506 combined) under the curve (dotted area and the dashed area combined) may be inversely proportional to the power delivered for UEGO sensor heating. The larger the area under the curve, the longer is the recovery time and lower is the power delivered by the battery for UEGO sensor heating.

Returning to FIG. 4, at 418, the routine includes determining if the power (P) delivered from the battery to the UEGO sensor heater is lower than a first threshold (threshold_1). In one example, threshold_1 may be estimated based on a minimum amount of power desired to heat the UEGO sensor within a first threshold duration after engine start such that cold-start emissions may be reduced (by switching to closed-loop fuel control). The first threshold duration may be 8 seconds.

If it is determined that the power (P) delivered from the battery to the UEGO sensor heater is lower than threshold_1, it may be inferred that the battery is degraded and is not be able to supply the desired power for UEGO sensor heating without delaying closed-loop engine control. At 420, battery degradation may be indicated and a diagnostics code (flag) may be set. The operator may be informed via a dashboard message to change the battery.

If the battery has not been changed prior to the immediately subsequent engine start, at 428, UEGO sensor heating strategy may be adjusted during the immediately subsequent engine start. In one example, the battery may be charged more aggressively to the maximum possible state of charge (SOC) prior to the immediately subsequent engine start. In another example, during the UEGO sensor heating (at the immediately subsequent engine start), the alternator may be engaged to supply the desired power to the UEGO sensor heater to expedite UEGO sensor heating. The amount of power supplied by the alternator may be a difference between the desired power for UEGO sensor heating and the power supplied by the battery. The alternator load may be adjusted to deliver the nominal (target) voltage (without voltage drop) to the heater during UEGO sensor heating. In one example, engaging the alternator may include, increasing field current through field windings in the alternator to increase alternator output power/voltage.

In yet another example, if the nominal voltage is not achieved, parasitic loss of battery power may be decreased by shedding load on the battery from one or more vehicle components. The vehicle components may include a cabin heating system (passenger seat heating, window and windshield defrosting) which may be disabled until the UEGO sensor heating is completed. In a further example, the UEGO heater may be supplied with voltage higher than battery voltage by disconnecting the battery charging by disengaging the battery and alternator.

If it is determined that the power (P) delivered from the battery to the UEGO sensor heater is lower than threshold_1, at 422, the routine includes determining if the voltage recovery time (T) is higher than a threshold time. The recovery time is an indication of optimal power supply to the heater and longer it takes the voltage to return to the nominal value (after a voltage drop), the lower is the efficiency of the battery. The threshold duration may be pre calibrated based on a recovery time for an optimally performing battery (such as a new battery).

If it is determined that the voltage recovery time (T) is higher than the threshold time, at 424, power delivered to the UEGO sensor heater during an immediately subsequent engine start may be increased to expedite UEGO sensor heating. The power delivered to the UEGO sensor heater may be proportional to the voltage recovery time (T), the power delivered increased with an increase in the voltage recovery time. In addition to battery power, the alternator may be engaged to increase the power delivered to the UEGO sensor heater.

The routine may then proceed to 426, wherein it is determined if the power (P) delivered from the battery to the UEGO sensor heater is lower than a second threshold (threshold_2). If it is determined that the voltage recovery time (T) is higher than the threshold time, the routine may also proceed to step 426. In one example, threshold_2 may be estimated based on an amount of power desired to heat the UEGO sensor within a second threshold duration after engine start such that cold-start emissions may be reduced (by switching to closed-loop fuel control). The desired power may be 356 watts and the second threshold duration may be 5 seconds. Threshold_2 may be higher than threshold_1. In one example, threshold_1 and threshold_2 may be calibrated based on an age of the sensor with the power requirement for obtaining light-off temperature within a desired time (after cold-start) changing based on the age of the sensor. The power requirement may increase with an increase in UEGO sensor age.

If it is determined if the power (P) delivered from the battery to the UEGO sensor heater is lower than threshold_2, it may be inferred that the battery performance is not optimal. However, since it has been determined that the power (P) delivered from the battery to the UEGO sensor heater is higher than threshold_1, the battery is not degraded and may be continued to be used for vehicle operation including UEGO sensor heating.

The routine may then continue to step 428. As previously elaborated, at 428, UEGO sensor heating strategy may be adjusted during the immediately subsequent engine start. In response to the power (P) delivered from the battery being lower than the second threshold power, the battery may be charged aggressively to reach a maximum state of charge prior to an immediately subsequent engine start by providing a first amount of power to the battery, and in response to the power being higher than the second threshold power, the battery may be charged by providing a second amount of power to the battery, the second amount of power less than the first amount of power. Said another way, in response to the power (P) delivered from the battery being lower than the second threshold power, the battery charging power may be increased by charging the battery to a maximum possible state of charge and in response to the power being higher than the second threshold power, the battery charging power may be maintained by charging the battery to a battery state of charge prior to the heating of the oxygen sensor.

If it is determined that the power (P) delivered from the battery to the UEGO sensor heater is higher than threshold_2, it may be inferred that the battery performance is optimal and at 430, current UEGO sensor heating strategy may be maintained during an immediately subsequent engine start.

In this way, while heating an oxygen sensor via a heater powered by a battery, during a first condition, increasing a battery charging power prior to an immediately subsequent engine start, during a second condition, indicating degradation of the battery, and during a third condition, maintaining the battery charging power prior to the immediately subsequent engine start. The first condition may include, a power delivered by the battery to the heater being lower than a first threshold, the second condition may include, the power delivered by the battery to the heater being lower than a second threshold but higher than the first threshold, and the third condition may include, the power delivered by the battery to the heater being higher than each of the first threshold and the second threshold.

FIG. 6 shows an example timeline 600 illustrating a performance monitoring routine of an on-board battery powering a heater (such as heater 307 of FIG. 3) used to heat an exhaust gas sensor (such as UEGO sensor 126 in FIG. 1) during cold-start conditions. The horizontal (x-axis) denotes time and the vertical markers t1-t7 identify significant times in the routine for monitoring the battery.

The first plot, line 602, indicates engine speed as estimated via a crankshaft sensor. The second plot, line 604, denotes an engine temperature as estimated via an engine coolant temperature sensor. Dashed line 605 denotes a threshold temperature below which an engine cold-start may be confirmed. The threshold temperature may correspond to a light-off temperature of an exhaust catalyst. The third plot, line 606, denotes an UEGO temperature as estimated via an engine exhaust temperature sensor. Dashed line 607 denotes a threshold (UEGO sensor light-off) temperature below which the UEGO sensor may not be able to accurately estimate exhaust oxygen content. The fourth plot, line 608, shows a voltage drop across the UEGO sensor heater as estimated based on a voltmeter or computed from the heater current (as estimated via a current sensor). The fifth plot, line 610, shows the total amount of power delivered to the UEGO sensor heater to heat the sensor to its light-off temperature during a cold-start. The dashed line 613 denotes a first threshold power below which the UEGO sensor heating takes a longer than desired time. The dashed line 615 denotes a second threshold power below which an aggressive charging of the battery is desired prior to the immediately subsequent engine start. The sixth plot, line 612, shows power delivered from the battery to the UEGO heater while the seventh plot, line 616, shows a power delivered from an alternator to the UEGO heater during heating of the UEGO sensor. The eighth plot, line 618, shows a change in state of charge of the battery supplying power to the UEGO sensor heater. The ninth plot, line 620, shows a flag denoting degradation of the battery.

Prior to time t1, the engine is off, with an engine speed of zero. For example, the vehicle is off (e.g., an ignition of the vehicle is in an "off" position, and the vehicle is powered down). The engine temperature is less than the threshold engine temperature, indicating that the engine is cold. For example, the engine is at ambient temperature ("ambient"). With the engine off, the oxygen sensor temperature are also at ambient temperature. No voltage is supplied to the oxygen sensor heater from the battery and/or the alternator, and thus, the heater power is zero and the battery state of charge (SOC) is constant. Since diagnostics of the battery is not yet initiated, the flag is in the off state.

At time t1, the engine is started responsive to a vehicle key-on event. For example, a vehicle operator may switch the ignition of the vehicle into an "on" position, powering on the vehicle and cranking the engine to a non-zero speed. Because the engine temperature is less than the threshold engine temperature when the engine is started, a cold start condition is inferred. The controller sends a command to the UEGO sensor heater to initiate heating of the sensor. For heating the UEGO sensor, voltage is supplied solely from the battery (alternator not engaged) to the heater. Between time t1 and t2, the UEGO sensor is heated via the heater causing the sensor temperature to steadily increase. During operation of the heater, the voltage across the heater drops from the nominal voltage of the battery and the battery SOC decreases.

At time t2, in response to the UEGO temperature increasing to the threshold (light-off) temperature, the controller sends a signal to the heater to discontinue UEGO sensor heating and voltage is no longer applied to the heater. The voltage increases to the nominal voltage. Based on the voltage drop during the UEGO sensor heating, the controller estimates the total power delivered for heating the UEGO sensor. The power delivered is above the first threshold 613 indicating that the battery is not degraded and the battery power is efficiently used for fast UEGO sensor light-off. The flag is maintained in off position. In response to the power delivered being lower than the second threshold 615, it is inferred that the battery is to be charged more aggressively prior to the immediately subsequent engine start.

However, if it took a longer time for the voltage drop to recover (as shown by dashed line 609) and the total power delivered to the heater was lower than the first threshold 613, a degradation in the battery would have been diagnosed and the flag would have been set at time t2 indicating the degradation.

Between time t3 and t4, the engine temperature reaches above the threshold temperature 605 and the UEGO temperature is maintained above the light-off temperature 607. Between time t4 and t5, the battery is aggressively charged to reach the maximum state of charge. Between time t4 and t5, the engine is operating to propel the vehicle and the battery is SOC is maximum.

At time t5, the engine is shut down and the engine speed reduces to zero. After the engine is non-operational for a period of time, between time t5 and t6, the engine is restarted at time t6. In response to the engine temperature being less than the threshold engine temperature 604, a cold-start condition is inferred. The controller sends a command to the UEGO sensor heater to initiate heating of the sensor. For heating the UEGO sensor, between time t6 and t7, voltage is supplied from the fully charged battery to the heater. As the UEGO sensor is heated via the heater, the sensor temperature steadily increases. During operation of the heater, the voltage across the heater drops from the nominal voltage of the battery and the battery SOC decreases.

As an example, if the total power supplied to the heater is lower than the first threshold power, power may be delivered from the alternator (as shown by dashed line 616) to supplement the power delivered by the battery in order to increase the total power supplied to the heater.

At time t7, in response to the UEGO temperature increasing to the threshold (light-off) temperature, the controller sends a signal to the heater to discontinue UEGO sensor heating and voltage is no longer applied to the heater. The voltage increases to the nominal voltage. Based on the voltage drop during the UEGO sensor heating, the controller estimates the power delivered for heating the UEGO sensor. The power delivered is above each of the first threshold 613 and the second threshold 615 indicating that the battery is not degraded and the battery charge was sufficient for optimally heating the UEGO sensor. The flag is maintained in off position. After time t7, the engine temperature reaches above the threshold temperature 605 and the UEGO temperature is maintained above the light-off temperature 607.

In this way, diagnostics of a vehicle battery may be carried out based on power delivered to the UEGO sensor during sensor heating. By identifying a state of the battery and suitably adjusting battery charging strategy for subsequent engine starts, UEGO sensor heating may be optimized. By engaging the alternator to provide the desired power, UEGO sensor heating may be expedited during subsequent engine starts. By using the voltage drop across the heater for estimating battery efficiency, additional sensors such as a UEGO temperature sensor may be eliminated. Overall, by ensuring availability of desired battery power for UEGO sensor heating, switching to the closed-loop engine control may be expedited, thereby improving fuel efficiency and emissions quality.

An example method comprises: in response to a power delivered from a battery, as estimated based on a drop in voltage during heating of an exhaust gas oxygen sensor, adjusting a battery charging strategy. In any preceding example, additionally or optionally, the oxygen sensor is heated by a heater coupled to the oxygen sensor and wherein the drop in voltage is estimated across the heater. In any or all of the preceding examples, additionally or optionally, the voltage drop is a function of a current flowing through a circuit of the heater and a resistance of the circuit, and wherein the power is a function of the current flowing through the circuit of the heater and the resistance of the circuit. In any or all of the preceding examples, additionally or optionally, the voltage drop is a difference between a lowest magnitude of voltage, across the circuit, attained during heating of the exhaust gas oxygen sensor and a nominal voltage of the battery, and a voltage recovery time is a time to attain the nominal voltage from the lowest magnitude of voltage. In any or all of the preceding examples, additionally or optionally, the power is estimated based on the lowest magnitude of voltage, the voltage recovery time, and the nominal voltage. In any or all of the preceding examples, the method further comprising, additionally or optionally, indicating degradation of the battery and notifying an operator in response to the power being lower than a first threshold power and wherein adjusting the battery charging strategy is based on the power being lower than a second threshold power, the second threshold power higher than the first threshold power. In any or all of the preceding examples, additionally or optionally, in response to the power being lower than the second threshold power, charging the battery aggressively to reach a maximum state of charge prior to an immediately subsequent engine start by providing a first amount of power to the battery, and in response to the power being higher than the second threshold power, charging the battery by providing a second amount of power to the battery, the second amount of power less than the first amount of power. In any or all of the preceding examples, additionally or optionally, the adjusting includes, during heating of the UEGO sensor at the immediately subsequent engine start, engaging an alternator to supply power to a heater, the power supplied by the alternator proportional to a difference between the power supplied by the battery and the second threshold power. In any or all of the preceding examples, additionally or optionally, the adjusting includes, during heating of the UEGO sensor at the immediately subsequent engine start, shedding electric load on the battery from one or more vehicle electric power consumers during heating of the oxygen sensor, the one or more vehicle electric power consumers including cabin heating system. In any or all of the preceding examples, the method further comprising. Additionally or optionally, in response to the voltage recovery time being higher than a threshold time, engaging the alternator to supply power to the heater during the immediately subsequent engine start. In any or all of the preceding examples, additionally or optionally, the exhaust gas oxygen sensor is heated during a cold-start condition until a light-off temperature is reached.

Another engine example method, comprises: while heating an oxygen sensor via a heater powered by a battery, during a first condition, increasing a battery charging power prior to an immediately subsequent engine start, during a second condition, indicating degradation of the battery, and during a third condition, maintaining the battery charging power prior to the immediately subsequent engine start. In any preceding example, additionally or optionally, the first condition includes, a power delivered by the battery to the heater being lower than a first threshold, wherein the second condition includes, the power delivered by the battery to the heater being lower than a second threshold but higher than the first threshold, and wherein the third condition includes, the power delivered by the battery to the heater being higher than each of the first threshold and the second threshold. In any or all of the preceding examples, additionally or optionally, the power delivered is estimated based on a drop in voltage from a nominal battery voltage during the heating of the oxygen sensor, and a time to recover to the nominal battery voltage. In any or all of the preceding examples, additionally or optionally, the increasing the battery charging power includes charging the battery to a maximum possible state of charge and the maintaining the battery charging power includes charging the battery to a battery state of charge prior to the heating of the oxygen sensor. In any or all of the preceding examples, additionally or optionally, the oxygen sensor is heated during a cold-start condition, the method further comprising, in response to the time to recover to the nominal voltage being higher than a threshold, increasing a power supplied to the oxygen sensor during immediately subsequent engine start by engaging an alternator. In any or all of the preceding examples, additionally or optionally, the heating of the oxygen sensor is continued until an operating temperature is reached where output current of the oxygen sensor is proportionate to a concentration of oxygen sensed via the oxygen sensor.

Yet another example engine system, comprises: a controller storing executable instructions in non-transitory memory that, when executed, cause the controller to: during a cold-start, supply voltage from a battery to a heater coupled to an oxygen sensor, housed in an exhaust passage, configured to measure an amount of oxygen in exhaust gas, to increase a temperature of the oxygen sensor to a light-off temperature, estimate a drop in voltage from a nominal battery voltage, estimate a recovery time for the voltage to increase to the nominal voltage, estimate a power supplied to the heater based on the drop in voltage, the nominal voltage, and the recovery time; and indicate the battery to be degraded in response to the power supplied being lower that a threshold power. In any preceding example, additionally or optionally, the threshold power correspond to a minimum power used for increasing the temperature of the oxygen sensor to the light-off temperature within a threshold duration. In any preceding example, additionally or optionally, the controller including further instructions to: in response to the recovery time being higher than a threshold, one or more of charge the battery to a maximum state of charge prior to an immediately subsequent cold-start condition and engage an alternator while operating the heater during the immediately subsequent cold-start condition.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to a power delivered from a battery, as estimated based on a drop in voltage during heating of an exhaust gas oxygen sensor, adjusting, via an electronic controller storing executable instructions in non-transitory memory, a battery charging strategy, and, in response to an estimated voltage recovery time being higher than a threshold time, engaging an alternator to supply power to the heater during an immediately subsequent engine start.

2. The method of claim 1, wherein the exhaust gas oxygen sensor is heated by a heater coupled to the exhaust gas oxygen sensor, and wherein the drop in voltage is estimated across the heater.

3. The method of claim 2, wherein the drop in voltage is a function of a current flowing through a circuit of the heater and a resistance of the circuit, and wherein the power is a function of the current flowing through the circuit of the heater and the resistance of the circuit.

4. The method of claim 3, wherein the drop in voltage is a difference between a lowest magnitude of voltage, across the circuit, attained during heating of the exhaust gas oxygen sensor and a nominal voltage of the battery, and the voltage recovery time is estimated as a time to attain the nominal voltage from the lowest magnitude of voltage.

5. The method of claim 4, wherein the power is estimated based on the lowest magnitude of voltage, the voltage recovery time, and the nominal voltage.

6. The method of claim 1, further comprising indicating degradation of the battery and notifying an operator in response to the power being lower than a first threshold power, and wherein adjusting the battery charging strategy is based on the power being lower than a second threshold power, the second threshold power higher than the first threshold power.

7. The method of claim 6, wherein the adjusting includes, in response to the power being lower than the second threshold power, charging the battery aggressively to reach a maximum state of charge prior to the immediately subsequent engine start by providing a first amount of power to the battery, and, in response to the power being higher than the second threshold power, charging the battery by providing a second amount of power to the battery, the second amount of power less than the first amount of power.

8. The method of claim 7, wherein the adjusting includes, during heating of the exhaust gas oxygen sensor at the immediately subsequent engine start, engaging the alternator to supply power to the heater, the power supplied by the alternator proportional to a difference between the power supplied by the battery and the second threshold power.

9. The method of claim 7, wherein the adjusting includes, during heating of the exhaust gas oxygen sensor at the immediately subsequent engine start, shedding electric load on the battery from one or more vehicle electric power consumers during heating of the exhaust gas oxygen sensor, the one or more vehicle electric power consumers including a cabin heating system.

10. The method of claim 1, wherein the exhaust gas oxygen sensor is heated during a cold-start condition until a light-off temperature is reached.

11. An engine method, comprising:

while heating an oxygen sensor via a heater powered by a battery, during a first condition, increasing, via an electronic controller storing executable instructions in non-transitory memory, a battery charging power prior to an immediately subsequent engine start and shedding electric load on the battery from one or more vehicle electric power consumers during heating of the oxygen sensor;

during a second condition, indicating, via the electronic controller, degradation of the battery; and during a third condition, maintaining, via the electronic controller, the battery charging power prior to the immediately subsequent engine start.

12. The method of claim 11, wherein the first condition includes a power delivered by the battery to the heater being lower than a second threshold but higher than a first threshold, wherein the second condition includes the power delivered by the battery to the heater being lower than the first threshold, and wherein the third condition includes the power delivered by the battery to the heater being higher than each of the first threshold and the second threshold.

13. The method of claim 12, wherein the power delivered is estimated based on a drop in voltage from a nominal battery voltage during the heating of the oxygen sensor, and a time to recover to the nominal battery voltage.

14. The method of claim 11, wherein the increasing the battery charging power includes charging the battery to a maximum possible state of charge and the maintaining the battery charging power includes charging the battery to a battery state of charge prior to the heating of the oxygen sensor.

15. The method of claim 14, wherein the oxygen sensor is heated during a cold-start condition, the method further comprising, in response to a time to recover to a nominal voltage being higher than a threshold, increasing a power supplied to the oxygen sensor during the immediately subsequent engine start by engaging an alternator.

16. The method of claim 11, wherein the heating of the oxygen sensor is continued until an operating temperature is reached where output current of the oxygen sensor is proportionate to a concentration of oxygen sensed via the oxygen sensor.

17. An engine system, comprising:

a controller storing executable instructions in non-transitory memory that, when executed, cause the controller to:

during a cold-start, supply voltage from a battery to a heater coupled to an oxygen sensor, housed in an exhaust passage, configured to measure an amount of oxygen in exhaust gas, to increase a temperature of the oxygen sensor to a light-off temperature;

estimate a drop in voltage from a nominal battery voltage;

estimate a recovery time for the voltage to increase to the nominal voltage;

estimate a power supplied to the heater based on the drop in voltage, the nominal voltage, and the recovery time; and indicate the battery to be degraded in response to the power supplied being lower than a threshold power.

18. The system of claim 17, wherein the threshold power corresponds to a minimum power used for increasing the temperature of the oxygen sensor to the light-off temperature within a threshold duration.

19. The system of claim 17, wherein the controller includes further instructions to, in response to the recovery time being higher than a threshold, one or more of charge the battery to a maximum state of charge prior to an immediately subsequent cold-start condition and engage an alternator while operating the heater during the immediately subsequent cold-start condition.

* * * * *